United States Patent [19]

Nagase et al.

[11] 4,099,496

[45] Jul. 11, 1978

[54] CARBURETOR HEAT SHIELD

[75] Inventors: Hidenobu Nagase, Wako; Eiji Kishida, Tokyo; Mitsuji Yoshihara, Asaka, all of Japan

[73] Assignee: Honda Giken Kogyo Kabushiki Kaisha, Tokyo, Japan

[21] Appl. No.: 735,952

[22] Filed: Oct. 27, 1976

[30] Foreign Application Priority Data

Oct. 27, 1975 [JP] Japan ..... 50-145281[U]

[51] Int. Cl.[2] ..... F02M 31/00; F02B 19/10

[52] U.S. Cl. ..... 123/41.31; 123/122 AB; 123/122 AC

[58] Field of Search ..... 123/41.04, 41.31, 41.6, 123/41.7, 122 AC, 122 AB

[56] References Cited

U.S. PATENT DOCUMENTS

| | | | |
|---|---|---|---|
| 1,430,792 | 10/1922 | Brush | 123/122 AC |
| 2,155,439 | 4/1939 | Morrison | 123/41.04 |
| 2,635,597 | 4/1953 | Boyce | 123/41.31 |
| 3,916,860 | 11/1975 | Nakano et al. | 123/122 AC |
| 3,994,270 | 11/1976 | Nakano et al. | 123/122 AB |
| 3,994,271 | 11/1976 | Ishizuya et al. | 123/122 AB |

*Primary Examiner*—Charles J. Myhre
*Assistant Examiner*—Sheldon Richter
*Attorney, Agent, or Firm*—Lyon & Lyon

[57] ABSTRACT

A system is disclosed for preventing overheating of a carburetor of the type which is placed with an intake manifold above an exhaust manifold. A heat insulating plate is disposed substantially horizontally between the intake manifold and the carburetor. This plate extends to substantially cover the area above the exhaust manifold. A substantially vertical plate extends upwardly from the heat insulating plate at an edge thereof most distant from the engine. A path is thereby created for the convection currents from the exhaust manifold to bypass the carburetor.

2 Claims, 2 Drawing Figures

CARBURETOR HEAT SHIELD

BACKGROUND OF THE INVENTION

The present invention is directed to a system for preventing automotive carburetor overheating.

With the advent of strict emission standards, a number of devices have been developed to increase engine efficiency and decrease exhausted pollutants. One approach has been to incorporate an intake and exhaust manifold arrangement whereby the intake manifold is positioned directly above the exhaust manifold. The intake manifold is thereby subjected to controlled heating using the hot exhaust. In this way, atomized fuel in the incoming air-fuel mixture may be properly vaporized. However, the limited space within the engine compartment of most automobiles and the lack of air flow past the exhaust manifold has often resulted in the uncontrolled convection of heated air from the exhaust manifold past the carburetor located directly above. Under such circumstances, the carburetor may become overheated and disabling fuel vaporization may occur. At the same time, a total blockage of convection currents may result in the overheating of other engine components or the passenger compartment located nearby.

SUMMARY OF THE INVENTION

The present invention is directed to a system for controlling the flow of hot air convected from about an exhaust manifold to prevent overheating of a carburetor located above the manifold. To overcome the difficulties associated with exhaust heated intake manifolds as discussed above, the present invention incorporates a horizontal plate extending from between the carburetor and its associated intake manifold. The plate includes a second, substantially vertical plate associated with the edge of the horizontal plate most distant from the engine. This vertically extending plate extends to about the height of the float chamber in the carburetor. Thus, fuel will not be preheated prior to carburetion in spite of the proximate exhaust heated intake system. A downwardly extending plate may also be employed from the edge of the horizontal plate to further control convection currents from about the exhaust manifold. The horizontal plate is also spaced from the automobile firewall to prevent an excessive buildup of heat in the immediate vicinity of the exhaust manifold.

Accordingly, it is an object of the present invention to provide a means for preventing overheating of a carburetor employed with an exhaust heated intake manifold system. Further objects and advantages will appear hereinafter.

DETAILED DESCRIPTION OF THE PREFERRED EMBODIMENT

Figure 1:
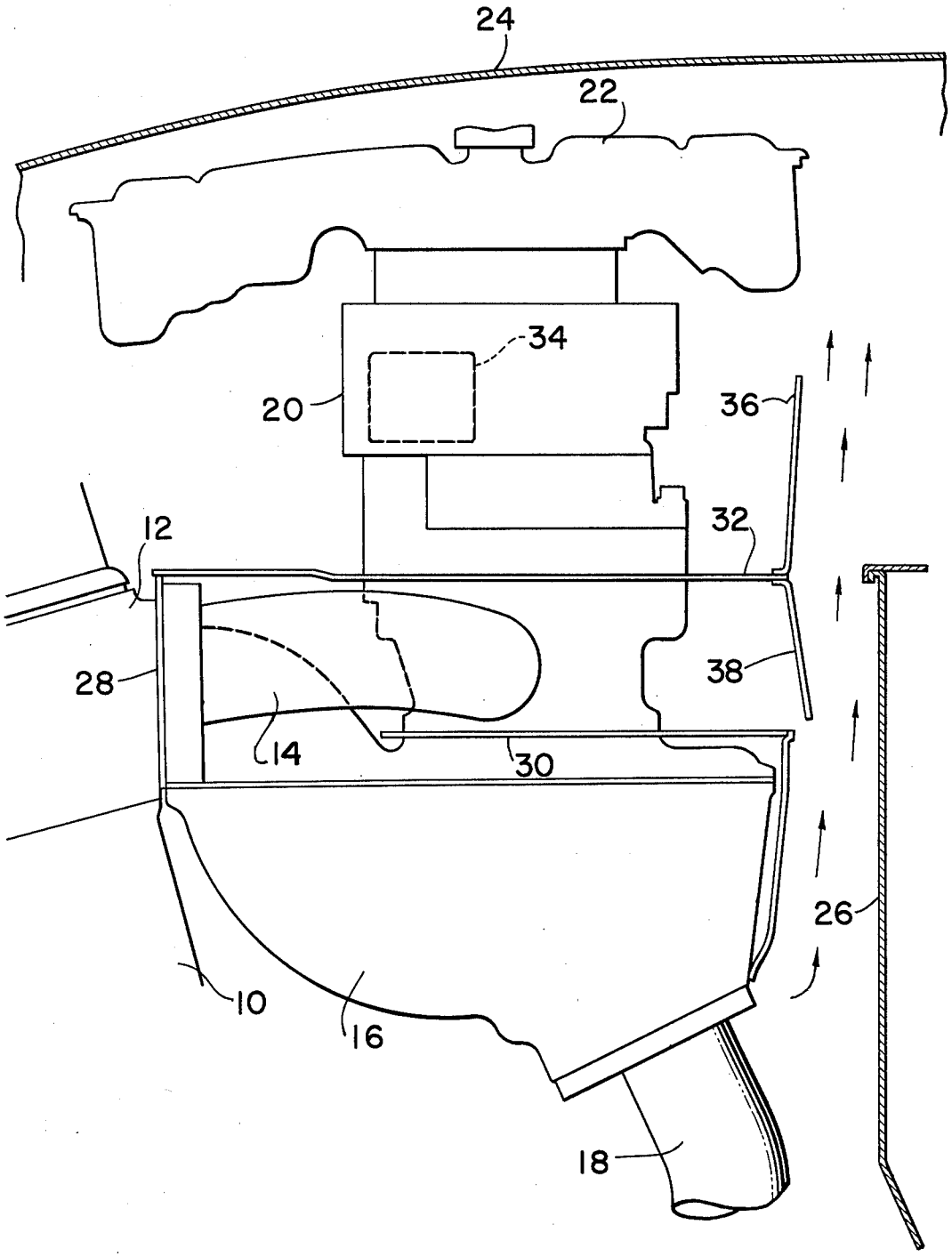
FIG. 1 is a side elevation of the present invention as associated with a transversally mounted engine.

Turning in detail to the drawings, FIG. 1 is most illustrative of the engine assembly. An engine 10 is shown in brief as including a head 12 which is associated with an intake manifold 14. The intake manifold 14 is positioned directly above an exhaust manifold 16 which is also associated with the head 12 for directing exhausted gases outwardly through the exhaust pipe 18. A carburetor, generally designated 20, is positioned above the intake manifold 14 and in turn supports an air cleaner 22.

The engine area is in part defined by the hood 24 and the firewall 26. In the present embodiment, the engine is placed with the crank shaft extending transversely relative to the automobile.

In associating the intake and exhaust manifolds 14 and 16 with the engine head 12, a gasket 28 is employed. Another gasket 30 is positioned between the intake manifold 14 and the exhaust manifold 16. The gasket 30 extends outwardly in a horizontal manner to cover an area above the outermost portion of the exhaust manifold 16. These gaskets 28 and 30 may typically be of heat insulative construction.

Figure 2:
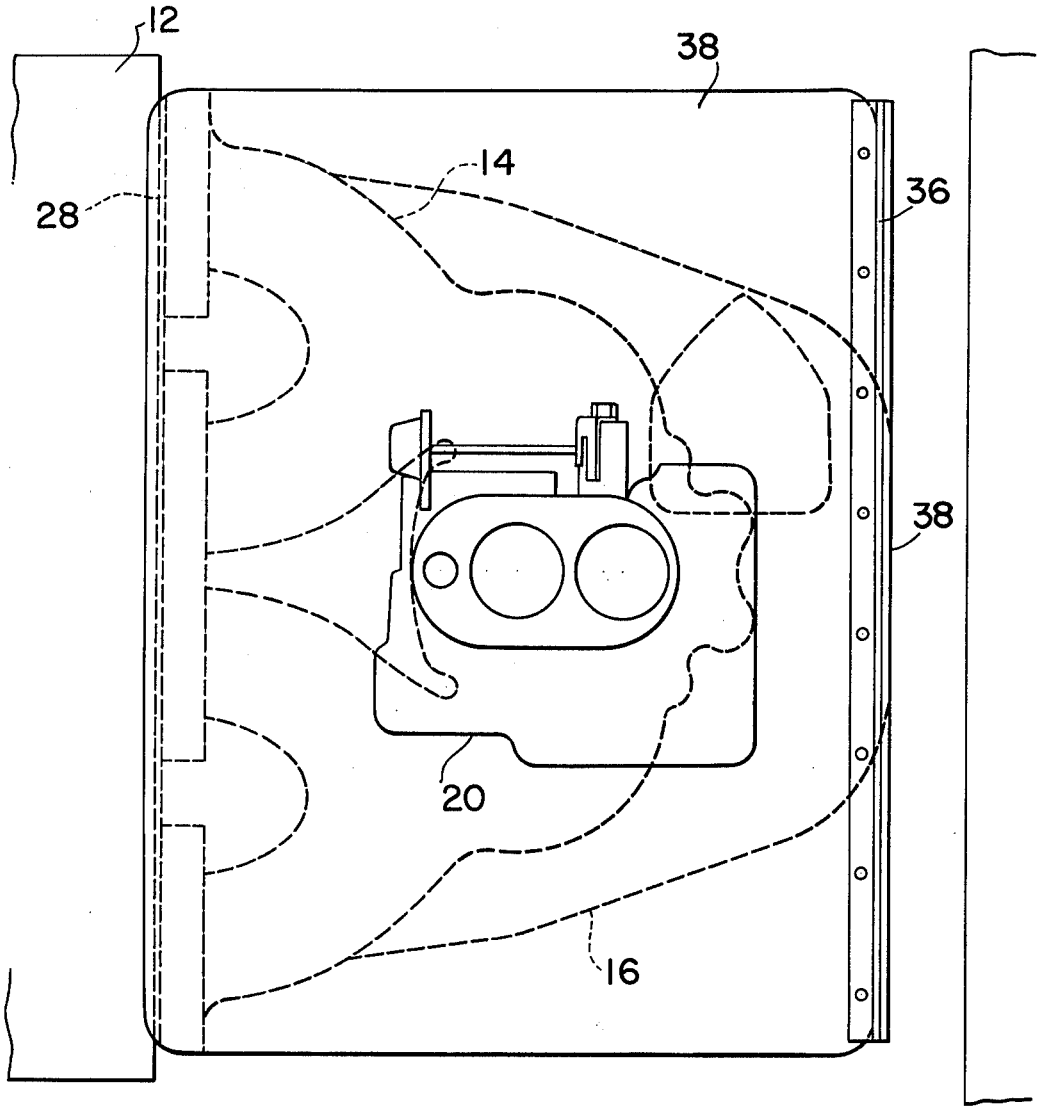
FIG. 2 is a plan view of the present invention assembled with an engine. The air cleaner has been removed for clarity.

Between the intake manifold 14 and the carburetor 20 a substantially flat plate is disposed horizontally. The plate 32 is also of a heat insulating construction. The plate 32 extends to cover about substantially all of the area above the exhaust manifold 16 as can be seen in FIG. 2. Heat from the exhaust manifold 16 is thus unable to directly radiate or convect upwardly to areas above the plate 32. However, convection can reach the carburetor 20 located above the plate 32 by steady state air currents and through re-radiation. Such convection heating can cause vaporization of fuel contained within the carburetor and particularly within the float chamber 34. Such a vaporization of fuel can be disabling to effective operation of the carburetor 20. To overcome this difficulty, a substantially vertically disposed plate 36 is employed. The plate 36 may be of heat insulating construction as is plate 32. The plate 36 is positioned at the edge of the plate 32 which is most distant from the engine. Furthermore, the plate 36 extends upwardly to a level of at least about the height of the float chamber 34 and preferably extends across the full width of the plate 32. Extending downwardly from the plate 32 is another plate 38. Plate 38 extends to a position near plate 30 and further preferably extends across the full width of the horizontal plate 32.

Heated air from the exhaust manifold 16 moves upwardly in convention currents between the engine assembly and the firewall 26. The employment of the plates 32, 36 and 38 insures that these convection currents do not directly approach the carburetor 20 and cause it to overheat. The horizontal plate 32 insures that no direct convection occurs while vertical plate 36 prevents the flow of hot air laterally by the carburetor 20. The downwardly extending plate 38, somewhat in combination with gasket 30, prevents uncontrolled heating of the intake manifold 14. The plate 36 and 38 are also removed a distance from the firewall 26 in order that convection currents may prevent an overheating of automotive conponents or the firewall down in the area of the exhaust manifold 16.

Thus, controlled convection of hot air provides controlled engine compartment temperatures and prevents both heating of the carburetor and uncontrolled heating of the intake manifold.

Having fully described our invention, it is to be understood that we are not to be limited to the details herein set forth but that our invention is of the full scope of the appended claims.

We claim:

1. An intake system for an automobile engine, including a carburetor having a float chamber and an intake manifold, said carburetor being mounted on top of said intake manifold, said intake manifold being of a type employed directly above an exhaust manifold, the improvement comprising: a first heat insulating plate positioned between the carburetor and the intake manifold in a substantially horizontal orientation, said first plate being capable of covering at least substantially all of the area above an exhaust manifold with which the intake maifold is to be associated, a second plate extending substantially vertically from an edge of said first plate most distant from said engine, to at least about the height of said float chamber and a third plate extends downwardly from said edge of said first plate most distant from said engine.

2. The intake system of claim 1 wherein said first plate extends to the engine above the intake manifold.

* * * * *